US010588434B2

(12) United States Patent
Felton

(10) Patent No.: US 10,588,434 B2
(45) Date of Patent: Mar. 17, 2020

(54) PICTURE FRAME

(71) Applicant: Roger Felton, London (GB)

(72) Inventor: Roger Felton, London (GB)

( * ) Notice: Subject to any disclaimer, the term of this patent is extended or adjusted under 35 U.S.C. 154(b) by 0 days.

(21) Appl. No.: 16/248,483

(22) Filed: Jan. 15, 2019

(65) Prior Publication Data

US 2019/0290027 A1 Sep. 26, 2019

(30) Foreign Application Priority Data

Mar. 26, 2018 (GB) ..... 1804839.7

(51) Int. Cl.
*A47G 1/06* (2006.01)

(52) U.S. Cl.
CPC ..... *A47G 1/0633* (2013.01)

(58) Field of Classification Search
CPC ..... A47G 1/0633
USPC ..... 40/786–789
See application file for complete search history.

(56) References Cited

U.S. PATENT DOCUMENTS

| | | | | | |
|---|---|---|---|---|---|
| 796,310 | A * | 8/1905 | Fisher | A47G 1/0633 | 40/786 |
| 1,223,409 | A * | 4/1917 | McMillian | A47G 1/0633 | 40/786 |
| 1,262,508 | A * | 4/1918 | Kaufman | A47G 1/0633 | 40/789 |
| 2,250,491 | A * | 7/1941 | Lurrain | A47G 1/06 | 40/781 |
| 2,562,590 | A | 7/1951 | Viglietta | | |
| 2,814,896 | A | 12/1955 | Fujikawa | | |
| 2,800,735 | A * | 7/1957 | Sanders | A47G 1/141 | 40/786 |

FOREIGN PATENT DOCUMENTS

| | | | | |
|---|---|---|---|---|
| CH | 243558 A | 4/1947 | | |
| DE | 4241870 A1 * | 6/1994 | | B65D 5/2009 |
| EP | 0950610 A1 * | 10/1999 | | B65D 5/2009 |
| FR | 2974283 A1 | 10/2012 | | |
| GB | 1042755 A * | 9/1966 | | B65D 5/2009 |
| GB | 2538107 A | 11/2016 | | |
| JP | 2000347575 A | 12/2000 | | |

* cited by examiner

*Primary Examiner* — Cassandra Davis
(74) *Attorney, Agent, or Firm* — Joseph W Mott; Hartman Titus PLC

(57) ABSTRACT

A picture framing blank (2) is made of laminar, creasable and foldable material that is adapted to form one side of a frame and a portion of a mat for mounting of an art work. The blank has first and second ends (4, 6) with elongate parallel inner and outer edges (8, 10) extending between the ends; and crease lines (28) parallel to the edges defining four strips (18, 20, 22, 24) which together create a hollow four sided rectangular box profile, and an outermost bracing strip (26) with a width substantially equal to a diagonal of said box profile. When folded the strips create a flattenable, pop up box section containing the bracing strip diagonally positioned across the hollow box section. Four blanks can be fitted together to form a frame.

5 Claims, 4 Drawing Sheets

PICTURE FRAME

TECHNICAL FIELD

The present invention relates to picture framing blanks for creating box frames that can be assembled from flat blanks and used to frame artwork, pictures or the like.

BACKGROUND ART

Picture frames made from cardboard blanks have been described, for example, in U.S. Pat. No. 2,814,896 (Fujikawa) 3 Dec. 1957. Existing designs suffer from various problems. The frame is typically of a fixed size and aspect ratio, whereas frames of various dimensions may be required. Folded card frames also lack structural rigidity. Such a frame is too large to be posted even in flat form. This type of frame is also expensive to produce due to the size of the blank and complexity of the cutting tool required.

A box frame is a deep frame into which, for example, a stretched canvas on a wooden frame can be inserted. A few mm clearance between the outer mouldings of the frame and the canvas is required so that the art can be inserted and removed and repositioned.

U.S. Pat. No. 796,310 (Fisher) 1 Aug. 1905 describes in one embodiment a frame assembled from a base card and four blanks which define triangular or rectangular mouldings. The blanks are of different designs for the short and long sides and the size of the frame is constrained by the base plate. Assembly also requires complex manipulation of slits and tabs to interconnect the base and moulding blanks.

SUMMARY OF INVENTION

The present invention is defined in the appended claims. Embodiments of the invention provide a modular framing system which allows separate moulding sections to be made from blanks that are supplied flat and which have pop-up box sections that can be erected to create an outer frame and provide structural rigidity. The moulding sections can be cut to length providing greater versatility than existing products. In a preferred embodiment the sections have at least four predefined lengths offering 16 different square, portrait or landscape standard frame dimensions. With a modicum of dexterity virtually any dimension can be achieved.

DESCRIPTION OF DRAWINGS

In order that the invention may be well understood, an embodiment thereof will now be described, by way of example only, with reference to the accompanying diagrammatic drawings, in which.

DESCRIPTION OF AN EMBODIMENT

Figure 1:
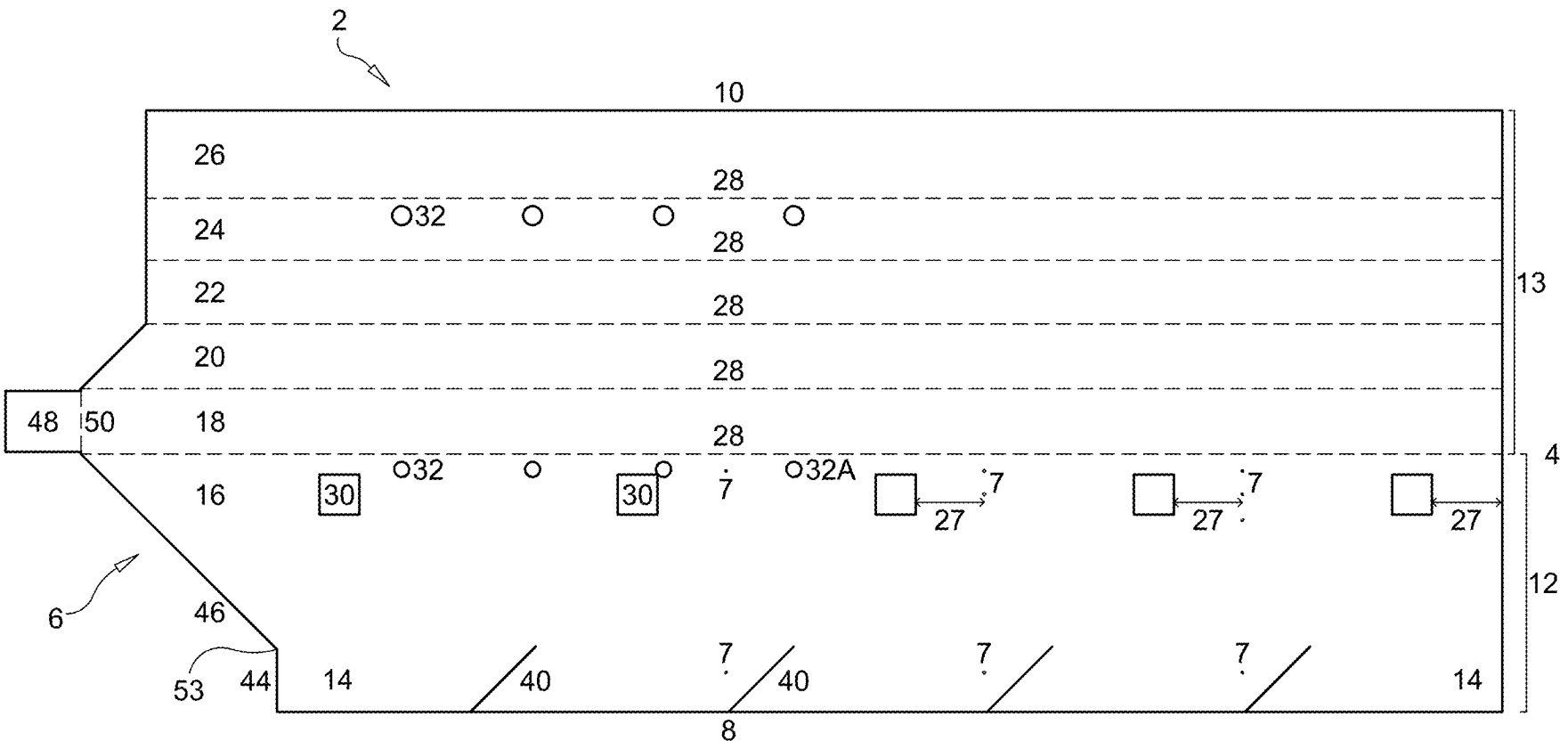
FIG. 1 shows a blank for creating one side moulding section of a picture frame.

The basic building block for the frame is an elongate blank as shown in FIG. 1. Four pieces of blank are required for a frame. The pieces are supplied in sets of fixed length and can be cut to size. In the embodiment described the product is configured to allow for four section lengths (the supplied length and three shorter lengths each requiring part of the square end of the blank to be cut away) but for shorter or longer blanks fewer or more predefined cutting positions can be offered. Each piece forms a moulding section that forms one side of a finished frame creating both an outer rectangular box section with a hollow cavity, and an inner flat mat portion onto which the art to be framed can be placed and retained in position using a non-permanent side of double-sided glue tabs which hold the frame together and will be described in more detail later.

Each blank piece has the configuration shown in FIG. 1. The blank 2 has two ends 4, 6 and parallel long sides 8, 10 and is made of paper, card or thin plastics material or metal foil capable of being scored, creased and folded flat on itself. In the remainder of this description card is referred to, but it will be appreciated that any laminar material having the required properties can be employed.

One end 4 is cut square and the other mitred end 6 is shaped as described later. The square end can be cut down by means of a square cut parallel to the end. The predefined cutting positions can be marked on the card by means of small pairs of nicks or pinholes 7. The provision of two sets of paired pinholes 7 at each predefined cutting position facilitates the alignment of a straight edge perpendicular to the long sides 8, 10. The cut can then be made across the entire width of the blank against this aligned straight edge with a craft knife or other suitable blade. Use of pinholes is preferred to print markings as this avoids an additional printing operation. In this embodiment the blank is designed for four optional lengths but it will be appreciated that the number of options can readily be changed.

The blank 2 is divided into a mat portion 12 adjacent an inner free long side 8, and a profile portion 13 that creates the rectangular box profile and an integrated stiffener. The mat portion comprises a base strip portion 16 and an inner flap portion 14 adjacent the free long side 8.

The profile portion is made up of six strips defining the four faces of the box section and an integral bracing strip or stiffener. A first base strip 16 lies in the same plane as the mat portion 12. The next outermost strip 18 provides an outer side wall of the moulding section. Strip 20 defines and upper face strip. Strip 22 provides the inner side wall. A second base strip 24 overlies the first base strip 16 in the folded configuration. The outermost strip 26 which terminates at the free edge 10 provides an integrated bracing strip or stiffener and has a width which is equivalent to the diagonal of the box profile or moulding section created by the remaining strips. When folded the strips create a flattenable, pop up box or moulding section containing the bracing strip diagonally positioned across the hollow box profile or section. Four blanks can be fitted together to form a frame.

Each face of the assembled moulding section is defined by a strip of card and in the case of the base by two overlaid strips of card. In the embodiment illustrated the box section is square so each face strip 16-24 has an equal width. However it will be appreciated that rectangular box section profiles are also possible in which the upstanding sides are broader or narrower than the width of the base and upper face strips.

The strips 16-26 are separated by pre-creased or scored fold lines 28. The first base strip 16 lies in the same plane as the mat portion 12 and is not visually separated. This first base strip lies adjacent the innermost crease line 28. Glue spots or pads 30 are provided within the first base strip 16 in order that the second base strip 24 can be physically secured to the first base strip during pre-assembly of the blank. The glue dots are arranged in order to leave a narrow slot 27 underneath the base of the moulding adjacent the square end 4 (either before or after cutting at a predefined cutting position) just sufficient to allow an edge of the mitred end 6 of the card of another blank to slide into the slot as it is manoeuvred into position during assembly of a frame. A slot length of no more than twice the depth of the box section is typically sufficient.

Within both of the strips 16, 24 that are to form the base of the box section, a series of four holes 32 are punched. The holes in the second base strip 24 are made slightly larger than the holes in the first base strip 16 so that they still overlap even in the case of minor misalignment during pre-assembly. In this embodiment four spaced holes are provided to correspond to the four predefined length options. A first hole 32*a* lies in the centre of the completed frame side if the blank has not been cut. The other holes are positioned so that one or other of them will be at the centre of the side of the completed frame if the blank has been cut down by cutting parallel to square end 4 at the predefined cutting positions. These holes are intended to receive a head of a fixing nail or screw that projects from a wall in order to hang the frame. Since the holes are provided in all blank pieces a finished frame can be hung in any orientation. The frame will sit flat against the wall because the nail head will go into the box frame cavity.

The three pre-defined cutting positions are marked by pinholes 7 in the first base strip 16 and in the inner flap 14 adjacent the edge of the long side 8 of the mat section where they will not be visible in the finished frame because they will be covered by the art.

A series of four spaced diagonal slits 40 are pre-cut at predetermined intervals into the inner flap 14 extending at 45° to the free long side 8 of the blank piece. These slits terminate at or just beyond the border between flap 14 and base strip 16 and are designed to receive a flap of an adjacent moulding section made from a similar blank piece. Since in this embodiment the piece is designed to create a section with three different optional lengths, there are three slits. More slits can be provided to give a greater range of length options in longer blanks. The user could also cut a parallel slit at the required location if using a non-standard length.

Figure 2A:
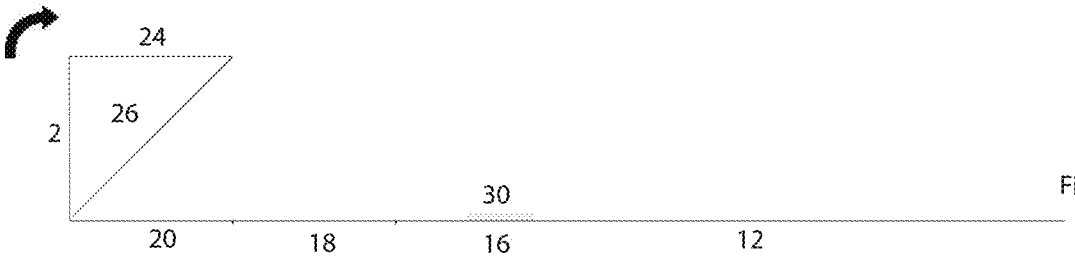
FIG. 2A-E shows a series of diagrams illustrating how a box section complete with integral diagonal bracing strip is preassembled.
Figure 2B:
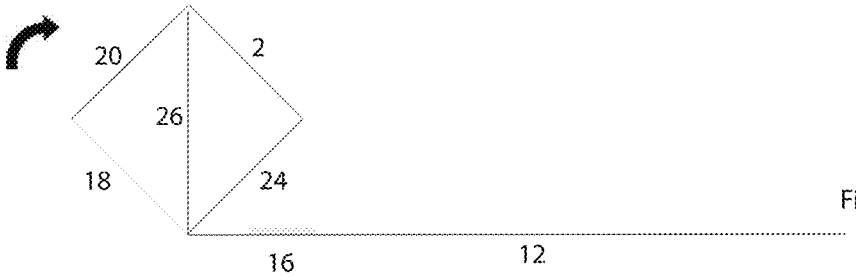
Figure 2C:
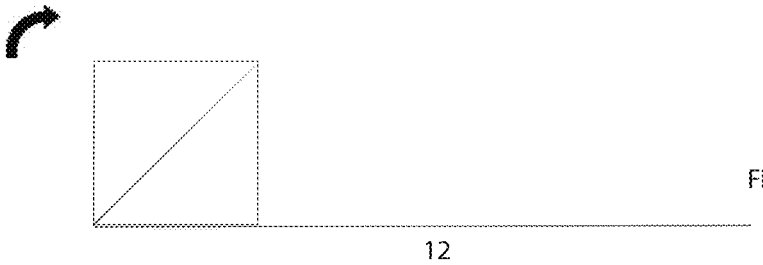
Figure 2D:
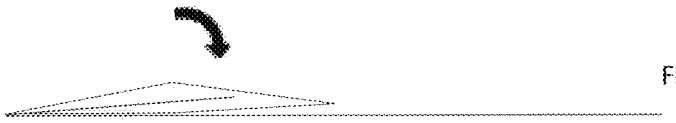

FIGS. 2A to 2E show how the blank can be pre-assembled. The strips are creased along the score lines so that the strips can be 'rolled up' into a rectangular box section in which the strip 26 sits across the diagonal with its free edge 10 trapped between the fold between strips 20 and 22 so that it is held in that position when the box section is erected. This strip 26 therefore acts as an integrated bracing strip or stiffener. The second base strip 24 overlies the first base strip. In pre-assembly the two base strips may be adhered together leaving only the previously described slot at the end 4. Alternatively, the glue spots 30 may be protected by removable tape so that the end user can unfold the blank in order to more accurately cut it to the required length. With either configuration, the blank can be supplied pre-folded and flattened as shown in FIG. 2D in 2E so that it can be popped up by the user in use yet supplied and delivered in a flat configuration.

Figure 2E:
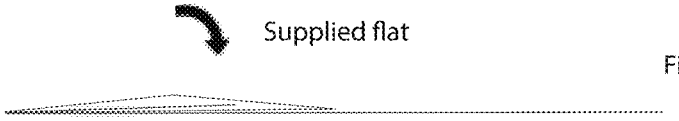

By supplying the blank pre-folded, the instructions for final assembly of the frame can be simpler. When the blank is pre-folded an outermost crease line between the bracing strip 26 and the adjacent strip 24 is folded through 360°. The innermost crease line is also folded through 360° as is a central crease line as shown in FIGS. 2D and 2E. The other two intermediate crease lines lie flat. The hollow box section can then easily be popped up by squeezing the intermediate crease lines so that every crease line is at 90° except for the 45° outermost crease line which allows the wider diagonal bracing strip to slip into position with the edge retained in the corner of the hollow box profile as shown in FIG. 2C.

The shaping of the other end 6 of the blank piece will now be described. The end 44 of the flap 14 is cut square and parallel to the other end 4. This square edge merges at point 53 with a diagonal edge 46 extending at 45° to the free long side 8. Flap 14 extends parallel to side 8 from point 53 to side 4. The edge 46 extends to an inner crease line 28 between the first base strip 16 and the outer side strip 18. At the end of the strip 18 there is formed a projecting tab 48. A score or crease line 50 parallel to the end 4 is formed between the tab 48 and outer side strip 18. The end of the upper face strip 20 is also a diagonal cut in the opposite direction so that, when the face is in its final position, the edge will sit above and parallel to the diagonally cut edge 46 beneath it. Finally, the ends of the remaining strips 22, 24, 26 are cut square to the outer long side 10.

The tab 48 is designed to be tucked inside the box section where it will be held in place without the need for adhesive.

Assembly of a Frame

Each of the four required moulding sections is created from an individual blank piece that has been cut across the end 4 to be the required length if necessary. Once cut, the profile portions are erected or "popped up" as shown in FIG. 2C. If the base strips 16, 24 were not previously adhered together, the glue spots 30 are uncovered and the two base strips secured together except at the slot 27.

Figures 3A, 3B, 3C:
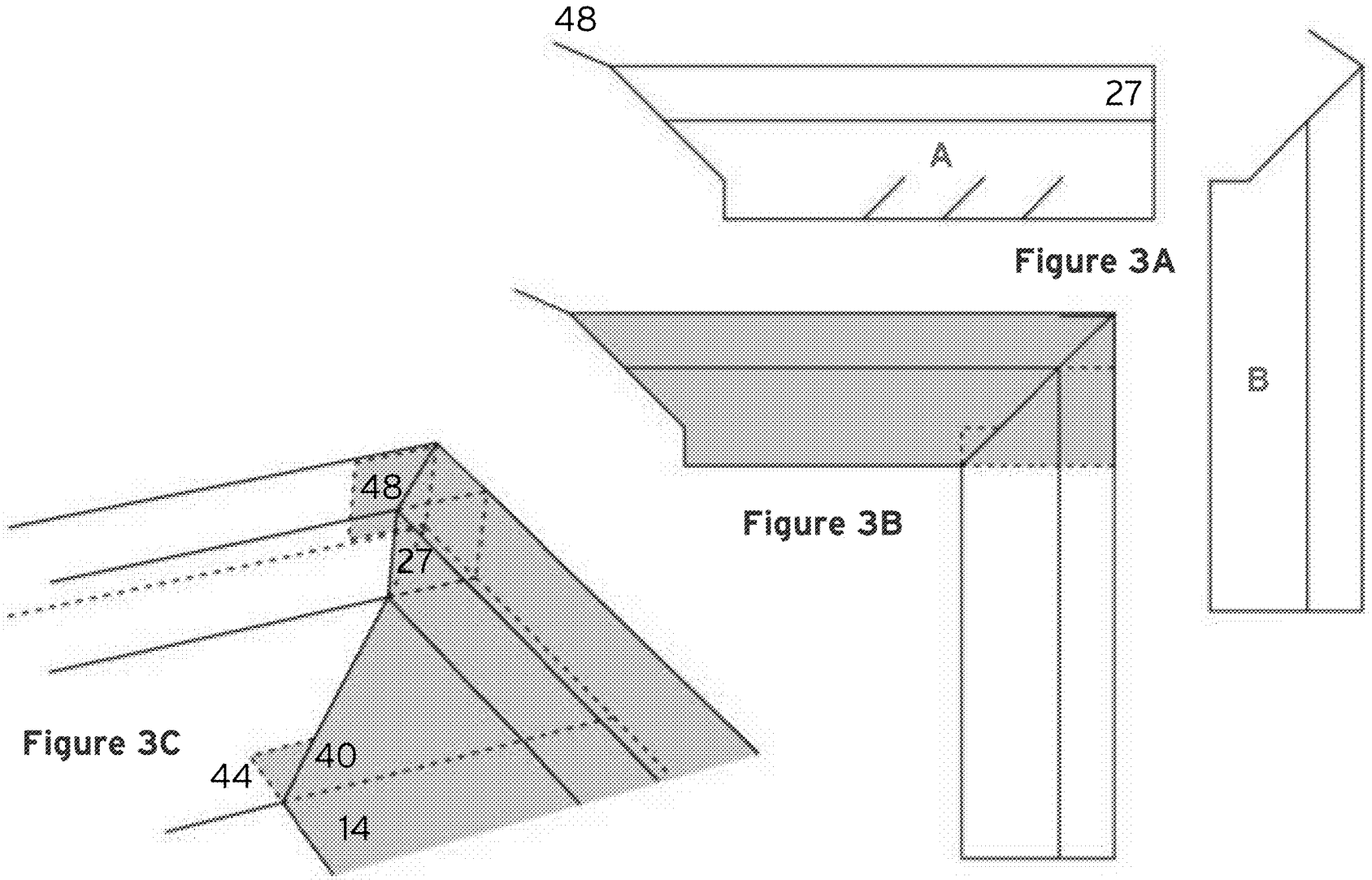
FIGS. 3A-3C shows a series of diagrams to show how two pieces of moulding section are interconnected.

FIG. 3 illustrates how adjacent sections A and B are interconnected to create a mitred corner of a frame once they have been popped up. At the end 6 of section B the inner flap 14 is slid into a matching slit 40 in section A. Section B can then be rotated so that the flap 48 can be received inside the box section of section A. As this happens, the edge 46 will move into the slot 27 so that the upper face 20 of section B can move over the upper face 20 of section A. The square end of the second, outer upstanding face of section B comes into contact with corresponding face of the box section in the adjacent section A. FIGS. 3B and 3C show a completed corner. When the corner is complete only a diagonal line across both the box section and the mat portion is visible to the user. At the outer edge the folded-in flap 48 conceals any gap at the end of the box section giving a neat outer appearance.

The next section is then added to the frame in the same way, and then the final section inserted. Until the final corner is assembled, it will be necessary to leave a little rotational flexibility in the other corners to allow the final mitre to be assembled. Once all the corners are joined the frame can be fully squared up. FIG. 4A shows a top plan view of a completed frame. In order to hold the ends of the flaps 14 into their slits 40 and also to enable mounting of an art work, double-sided glue tabs 52 are attached to each inner corner of flaps 14 across the overlaps. Such glue tabs are commercially available and have a foam central layer with adhesive on each face protected by a removable covering. For this application the tabs with permanent adhesive on one face and semi-permanent or low-tack adhesive on the other face are used. The face with permanent adhesive is used to secure the corners of the frame. The art can then be placed on top and held in place by the semi-permanent adhesive on the other faces of the tabs. Semi-permanent adhesive allows the art to be repositioned or replaced as desired. The frame can be hung using an appropriate central hole 32 in the uppermost section.

Figure 4B:
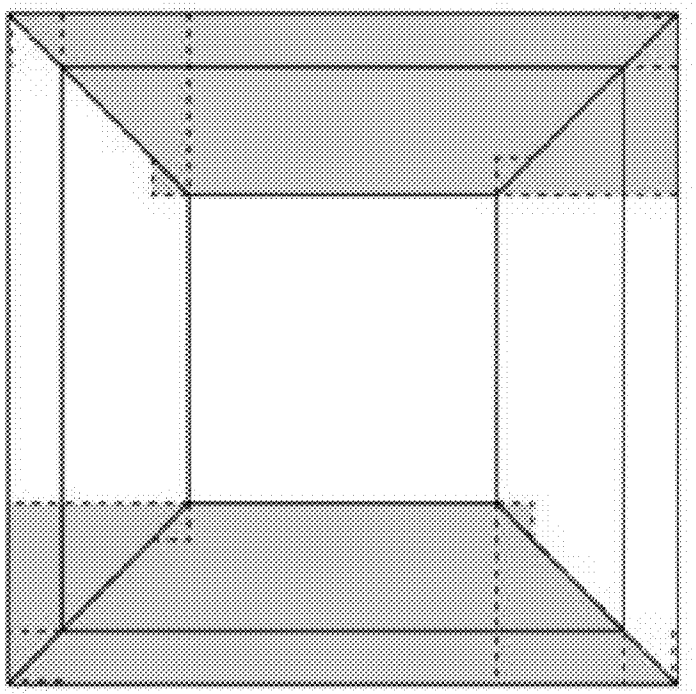
FIGS. 4A and 4B shows a plan view of a completed frame.
Figure 4A:
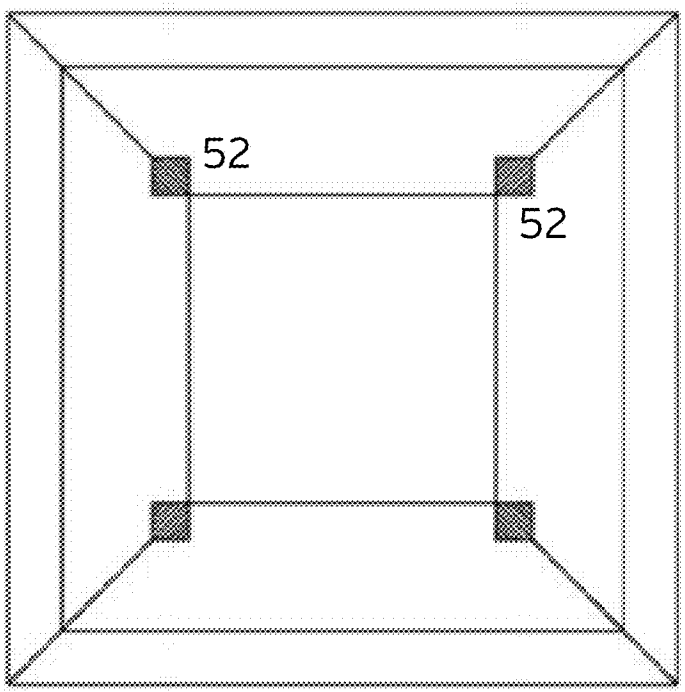

FIG. 4B shows how the frame sections overlap with the square ends at the rear. In this figure it can be seen how the diagonal edge of one blank passes through the slot 27.

The length of the illustrated blank is 580 mm providing a maximum frame dimension of 500 mm. The sets of four blanks are capable of being shipped in packages of five or more frame kits. Suitable card thicknesses are 270-350 gsm. Larger sizes can, of course, be created depending on available material size and suitable thickness. Plastic lamina such as Polypropylene (PP) or other foldable/creasable substrates can be used instead of card.

The frames can be provided in any colour or pattern effect by for example, the use of printed or textured card.

The assembly of the frame to the required size requires, at most, only a simple straight cut using scissors or board cutter or scalpel and some easy manipulation to "pop up" the box profiles and assemble four blanks together within a few minutes.

What is claimed is:

1. A picture framing blank of laminar, creasable and foldable material that is adapted to form one side of a frame and a portion of a mat for mounting of an art work; the blank comprising first and second ends (4, 6) with elongate parallel inner and outer edges (8,10) extending between the ends; crease lines (28) parallel to the edges defining four strips (18, 20, 22, 24) which together create a hollow four sided rectangular box profile when assembled; an innermost mat portion (12) extending inwardly from the box profile when assembled; an outermost bracing strip (26) with a width substantially equal to a diagonal of said box profile; and adhesive means (30) to enable the strip (24) adjacent the bracing strip (26) to be adhered to a portion (16) of the blank adjacent an innermost crease line (28), wherein the strip (24) adjacent the bracing strip (26) is secured to a portion (16) of the blank adjacent an innermost crease line (28) leaving an open slot (27) adjacent the first end (4), into which an edge of an adjacent blank can be slid; and wherein the second end (6) of the blank has a diagonal edge (46) extending inwardly away from the innermost crease line and further comprises a flap (14) along its inner edge (8) in which at least one diagonal slit (40) is provided in order to receive an end of a flap of another blank in order to create a mitred corner of a frame when two blanks are assembled together.

2. The blank of claim 1, further comprising a plurality of diagonal slits (40) in flap (14) at predetermined intervals.

3. The blank of claim 1, wherein predefined cutting positions are marked on the blank.

4. The blank of claim 3, wherein the cutting positions are marked by a pair of pinholes adjacent the inner edge (8) aligned perpendicular to said inner edge.

5. The blank of claim 1, further comprising a creased tab (48) projecting from its second end (6) at the position of the strip (18) which defines an outer upstanding side when the box profile has been assembled.

* * * * *